US008994196B2

(12) United States Patent
Lee et al.

(10) Patent No.: US 8,994,196 B2
(45) Date of Patent: Mar. 31, 2015

(54) SYSTEM AND METHOD FOR DIRECTIONAL GRINDING ON BACKSIDE OF A SEMICONDUCTOR WAFER

(75) Inventors: SungYoon Lee, Inchon-Si (KR); JungHoon Shin, Choongbook (KR); BoHan Yoon, Pusan (KR)

(73) Assignee: STATS ChipPAC, Ltd., Singapore (SG)

( * ) Notice: Subject to any disclaimer, the term of this patent is extended or adjusted under 35 U.S.C. 154(b) by 388 days.

(21) Appl. No.: 13/005,666

(22) Filed: Jan. 13, 2011

(65) Prior Publication Data

US 2011/0101546 A1 May 5, 2011

Related U.S. Application Data

(62) Division of application No. 11/852,771, filed on Sep. 10, 2007, now Pat. No. 7,892,072.

(51) Int. Cl.

| | |
|---|---|
| ***H01L 23/544*** | (2006.01) |
| ***H01L 29/06*** | (2006.01) |
| ***B24B 7/22*** | (2006.01) |

(52) U.S. Cl.

CPC ..... *B24B 7/228* (2013.01)
USPC ..... 257/797; 257/618; 257/622; 257/E23.179

(58) Field of Classification Search

CPC ..... B24B 7/228
USPC ..... 257/E21.237, E23.179, 797, 618, 622
See application file for complete search history.

(56) References Cited

U.S. PATENT DOCUMENTS

| | | | | |
|---|---|---|---|---|
| 4,096,619 | A | 6/1978 | Cook, Jr. | |
| 6,171,873 | B1 * | 1/2001 | Mendelson et al. | 438/14 |
| 6,184,064 | B1 | 2/2001 | Jiang et al. | |
| 6,261,919 | B1 * | 7/2001 | Omizo | 438/401 |
| 7,238,543 | B2 | 7/2007 | Tandy et al. | |
| 7,892,072 | B2 * | 2/2011 | Lee et al. | 451/41 |
| 2004/0099963 | A1 * | 5/2004 | Holloway et al. | 257/797 |
| 2006/0079011 | A1 | 4/2006 | Tandy et al. | |
| 2009/0247056 | A1 * | 10/2009 | Masuda | 451/54 |

OTHER PUBLICATIONS

McGuire, K. et al., The Influence of backgringding on the fracture strength of 100 mm diameter (111) P-type Silicon Wafers, Journal of Materials Science 32, 1997, 1017-1024.

Tsai, M.Y. et al., Determination of Silicon Die Strength, Electronic Components and Technology Conference, 2005, Proceedings, 55th, May 31-Jun. 3, 2005. pp. 1155-1162 vol. 2.

* cited by examiner

*Primary Examiner* — Nitin Parekh

(74) *Attorney, Agent, or Firm* — Robert D. Atkins; Atkins and Associates, P.C.

(57) ABSTRACT

A semiconductor device includes a backing plate, a semiconductor wafer, and integrated devices. The semiconductor wafer includes a plurality of semiconductor die having edges oriented along a reference line, a front surface facing the backing plate, and a backside surface. The backside surface is formed opposite the front surface and includes linear grind marks oriented along the reference line and diagonal with respect to the edges of the plurality of semiconductor die. The linear grind marks are formed by a linear motion of an abrasive surface, such as by a cylinder or wheel having an abrasive surface, and in one embodiment are oriented at 45 degrees with respect to the reference line. The linear grind marks increase a strength of the plurality of semiconductor die to resist cracking. Integrated devices are formed on the front surface of the semiconductor wafer.

25 Claims, 3 Drawing Sheets

SYSTEM AND METHOD FOR DIRECTIONAL GRINDING ON BACKSIDE OF A SEMICONDUCTOR WAFER

CLAIM TO DOMESTIC PRIORITY

The present application is a division of U.S. patent application Ser. No. 11/852,771, now U.S. Pat. No. 7,892,072, filed Sep. 10, 2007, and claims priority to the foregoing parent application pursuant to 35 U.S.C. §121.

FIELD OF THE INVENTION

The present invention relates in general to semiconductor wafer manufacturing and, more particularly, to a system and method of directional grinding on backside of a semiconductor wafer.

BACKGROUND OF THE INVENTION

Semiconductor devices are found in many products used in modern society. Semiconductors find applications in consumer items such as entertainment, communications, and household items markets. In the industrial or commercial market, semiconductors are found in military, aviation, automotive, industrial controllers, and office equipment.

The manufacture of semiconductor devices involves formation of a wafer having a plurality of die. Each die contains hundreds or thousands of transistors and other active and passive devices performing one or more electrical functions. For a given wafer, each die from the wafer performs the same electrical function. Front-end manufacturing generally refers to formation of the devices on the wafer. Back-end manufacturing refers to cutting or singulating the finished wafer into the individual die and then packaging the die for structural support and environmental isolation.

A semiconductor wafer generally includes an active front side surface having integrated circuits formed thereon, and a backside surface formed with bulk semiconductor material, e.g., silicon. During the front-end manufacturing, the wafer is typically subject to a grinding operation on the backside to remove excess bulk semiconductor material. The front side of the wafer is mounted to protective tape and placed front side down on a backing plate or chuck. A grinding wheel 12 is applied in a rotational motion to the backside surface of semiconductor wafer 14 to remove a portion of the bulk semiconductor material and create a substantially planar surface, as shown in FIG. 1. Grinding wheel 12 and wafer 14 each rotate in opposite directions. The backside grinding reduces the thickness of the integrated circuit chips, allows smaller packaging, and reduces stress in laminated packages.

Many manufacturers prefer to use rotational backside grinding on the wafer in lieu of chemical mechanical polishing (CMP) to remove excess semiconductor material and produce a planar surface. The ion contamination in slurry used in CMP can cause electrical malfunctions in the device. However, non-polished wafers still have many problems, including susceptibility of the die to cracking around the edges. The backside grinding may involve coarse grinding followed by fine grinding to remove excess semiconductor material and other irregularities from the backside surface. The grinding process leaves arc-shaped curves or marks in the wafer surface. The grinding marks extend radially outward from the wafer center.

In analyzing semiconductor die failures, the individual die are known to have problems with cracking along lines parallel or normal to the edges of the die. The die failure is attributed to the radial grind marks creating a weak plane in the crystal lattice structure (100) of the silicon wafer. The strength of the die depends upon the angle of the grind marks, ranging from a maximum value at zero degrees to a minimal value at 90 degrees. The highest risk of die cracking occurs when the grind marks run along the same line as the die edge. Intermediate die strength areas occur between about 40-70 degrees. In any case, the angle of the grind marks influences the strength of the wafer and accordingly the rate of die failures due to cracking.

A need exists to reduce die cracking arising from backside wafer grinding.

SUMMARY OF THE INVENTION

In one embodiment, the present invention is a semiconductor device comprising a backing plate, a semiconductor wafer, and integrated devices. The semiconductor wafer includes a plurality of semiconductor die having edges oriented along a reference line, a front surface facing the backing plate, and a backside surface formed opposite the front surface. The backside surface includes linear grind marks formed on the backside surface of the semiconductor wafer and oriented along the reference line and diagonal with respect to the edges of the plurality of semiconductor die. The linear grind marks are formed by a linear motion of an abrasive surface. The integrated devices are formed on the front surface of the semiconductor wafer.

In another embodiment, the present invention is a semiconductor device comprising a semiconductor wafer and active or passive devices. The semiconductor wafer includes a plurality of semiconductor die, a front surface, and a backside surface formed opposite the front surface. The backside surface includes linear grind marks oriented diagonal with respect to edges of the plurality of semiconductor die. The linear grind marks are formed by a linear motion of an abrasive surface. The active or passive devices are formed on the front surface of the semiconductor wafer.

In another embodiment, the present invention is a semiconductor device comprising a semiconductor wafer including a semiconductor die, a front surface, and a backside surface. The backside surface has linear grind marks oriented diagonal with respect to an edge of the semiconductor die. The linear grind marks are formed by a linear motion of an abrasive surface.

In another embodiment, the present invention is a semiconductor device comprising a semiconductor die and integrated devices. The semiconductor die includes a front surface, and a backside surface having linear grind marks oriented diagonal with respect to edges of the semiconductor die. The integrated devices are formed on the front surface of the semiconductor die.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

The manufacture of semiconductor devices involves formation of a wafer having a plurality of die. Each die contains hundreds or thousands of transistors and other active and passive devices performing one or more electrical functions. For a given wafer, each die from the wafer performs the same electrical function. Front-end manufacturing generally refers to formation of the transistors on the wafer. Back-end manufacturing refers to cutting or singulating the finished wafer into the individual die and then packaging the die for structural support and environmental isolation.

A semiconductor wafer generally includes an active front side surface having integrated circuits disposed thereon, and a backside surface formed with bulk semiconductor material, e.g., silicon. The active front side surface contains a plurality of semiconductor die having edges defining a rectangular form factor. The active surface is formed by a variety of semiconductor processes, including layering, patterning, doping, and heat treatment. In the layering process, semiconductor materials are grown or deposited on the substrate by techniques involving thermal oxidation, nitridation, chemical vapor deposition, evaporation, and sputtering. Patterning involves use of photolithography to mask areas of the surface and etch away undesired material to form specific structures. The doping process injects concentrations of dopant material by thermal diffusion or ion implantation. The active surface is substantially planar and uniform with electrical interconnects, such as bond wires.

During the manufacturing process, the semiconductor wafer is typically subject to a grinding operation on the backside to remove excess bulk semiconductor material. Many manufacturers prefer to use backside grinding on the wafer in lieu of chemical mechanical polishing (CMP) because the ion contamination in slurry used in CMP can cause electrical malfunction in the device.

Figure 1:
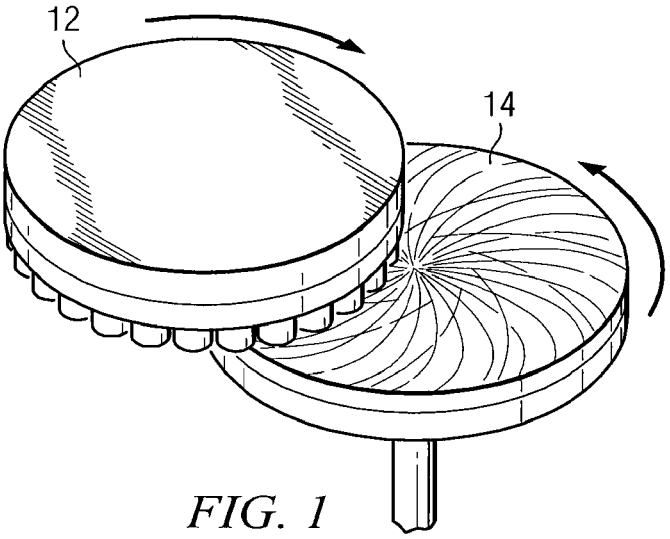
FIG. 1 (PRIOR ART)
FIG. 1 illustrates a conventional rotational backside grinding process on a semiconductor wafer.
Figure 2:
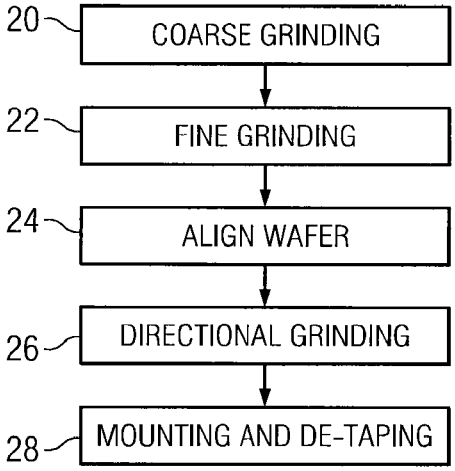
FIG. 2 illustrates a backside grinding process for removing semiconductor material.

In FIG. 2, the backside grinding involves coarse grinding in block 20 followed by fine grinding in block 22. Prior to back grinding, the backside surface of the semiconductor wafer exhibits a substantially non-planar contour in various different shapes, including sinuate, square, triangular, saw tooth, and the like, at a variety of different depths as measured from peak-to-valley of each contour. The coarse grinding is performed with a 300-600 mesh count wheel. The fine grinding is performed with a 2000 mesh count wheel. The backgrinding removes excess bulk semiconductor material and other backside surface irregularities and create a substantially planar surface.

Figure 3:
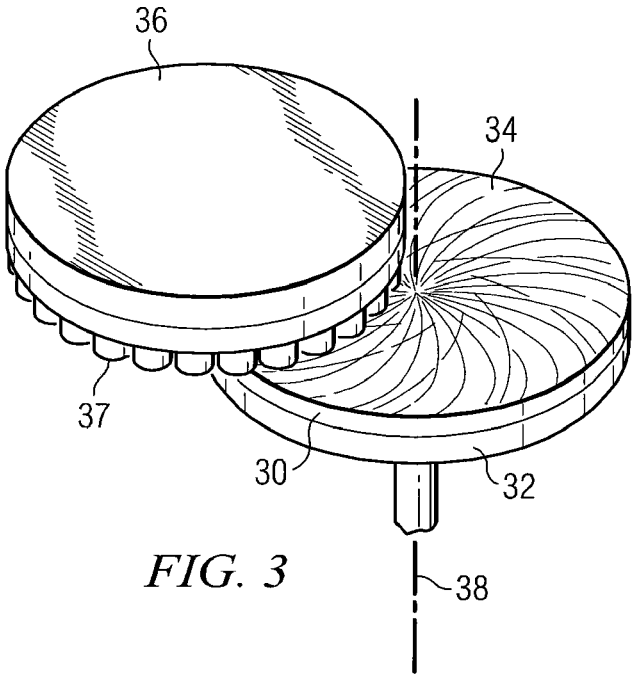
FIG. 3 illustrates a first rotational grinding operation producing arc-shaped grind marks.

In FIG. 3, semiconductor wafer 30 is shown with a front surface having active devices and a back surface 34. In one embodiment, semiconductor wafer 30 is attached to a backing plate or chuck 32 with the front side of the wafer facing down. The backing plate holds semiconductor wafer 30 fixed in vertical and horizontal planes. Grinding wheel 36 with abrasive surface 37 is applied to the backside surface of semiconductor wafer 30. In one embodiment, the grinding wheel remains stationary while semiconductor wafer 30 rotates with the backing plate about axis of rotation 38. Alternately, grinding wheel 36 and wafer 30 each rotate in opposite directions to remove excess bulk semiconductor material.

In the process of removing the excess bulk semiconductor material, the coarse and fine grinding steps leave wheel arc-shaped curves or radial marks in the wafer surface. The grinding marks extend radially outward from the wafer center, as shown in FIG. 3. However, the radial grind marks are known to weaken the crystal lattice structure of the silicon wafer and subject the die to cracking around the edges. It is desirable to remove the radial grind marks to reduce die failures due to cracking.

In block 24 of FIG. 2, the semiconductor wafer is aligned in preparation for the direction grinding in block 26. As described below, the directional grinding removes the radial grind marks formed by the coarse and fine grinding and creates linear grind marks or lines in the backside surface of the wafer. The wafer is aligned to control the orientation of the linear grind marks relative to the edges of the rectangular die.

Figure 4:
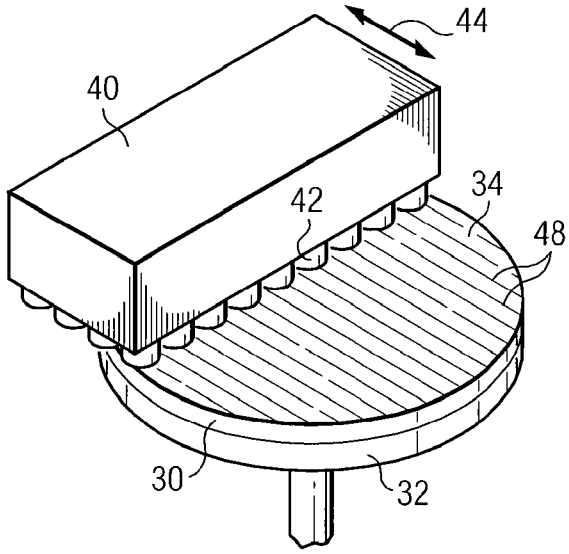
FIG. 4 illustrates a second directional grinding operation producing linear grind marks formed diagonal to edges of the die.

A directional grinding is performed to the backside surface of the semiconductor wafer in block 26. The directional grinding involves fixing semiconductor wafer 30 to a backing plate or chuck 32 with the front side of the wafer facing down. A grinding platform 40 having abrasive surface 42 is applied to the backside surface 34, as shown in FIG. 4. In one embodiment, wafer 30 remains stationary while grinding platform 40 moves back and forth as shown by directional arrows 44. Alternatively, grinding platform 40 remains stationary while wafer 30 moves back and forth according to directional arrows 44. In either case, the abrasive surface 42 of grinding platform 40 grinds semiconductor wafer 30 to remove the radial grind marks from the coarse and fine grinding steps and creates linear grind marks or lines 48 in backside surface 34, although during that process wafer 30 possess both radial grind marks from the coarse and fine grinding steps and linear grind marks or lines 48 in backside surface 34. The abrasive surface used in the directional grinding process is ultra-fine in comparison to the coarse grinding or fine grinding, e.g., having at least 4000 mesh count. Thus, the purpose of the coarse and fine grinding in steps 20 and 22 is to remove excess bulk semiconductor material from the backside of the wafer. The purpose of directional grinding in step 26 is to remove the radial grind marks produced by the coarse and fine grinding steps and leave only linear grind marks on the backside surface of the wafer.

Figure 5:
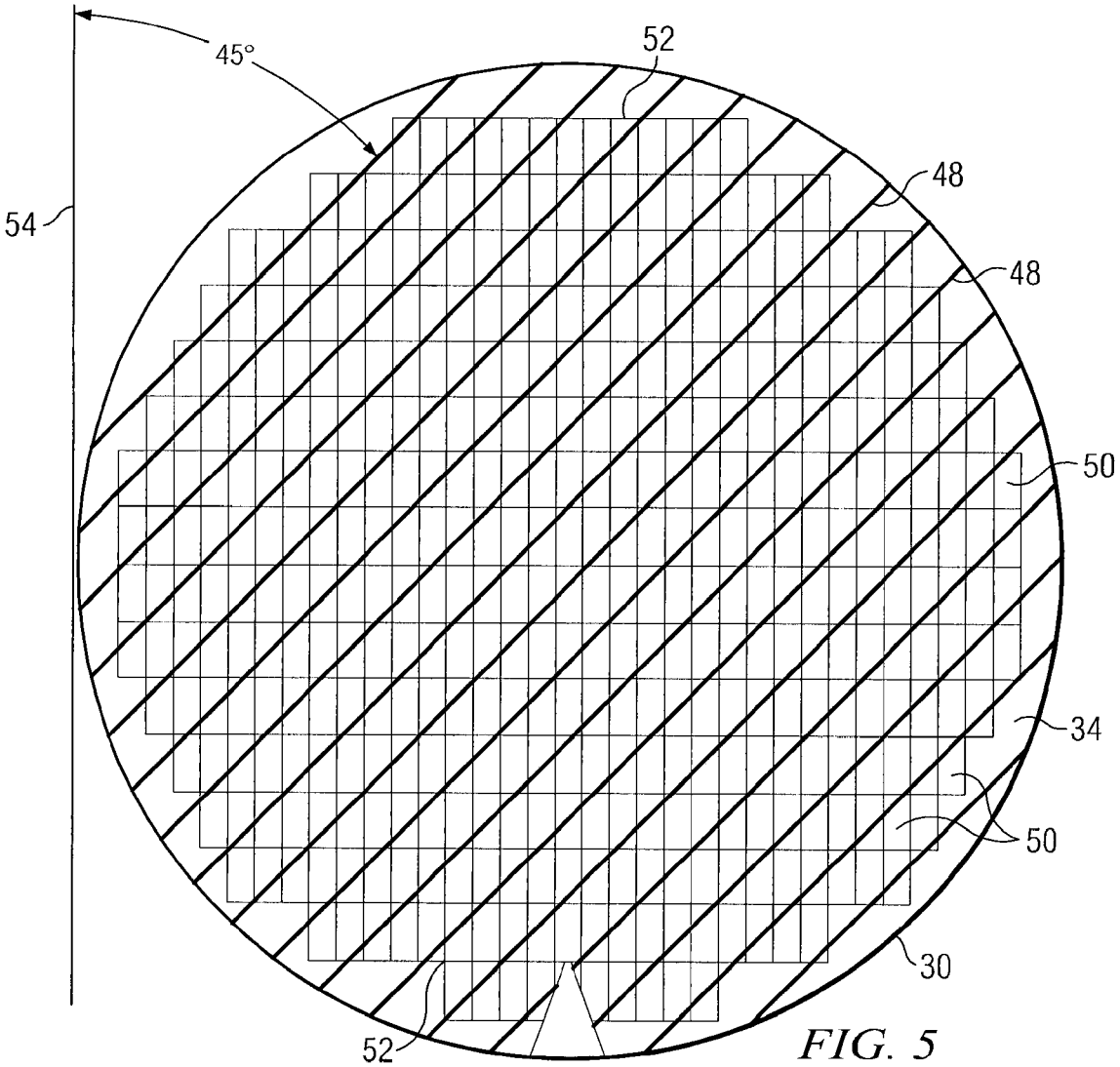
FIG. 5 illustrates grind marks oriented on a diagonal with respect to edges of the die.

In the alignment process 24, the semiconductor wafer is positioned so that the directional grinding creates linear grind marks which are uniformly diagonal with respect to reference line 54 oriented along the edges of die 50 as shown in FIG. 5. In one embodiment, the wafer is oriented so that the grind marks are aligned about 45 degrees with respect to reference line 54 which are parallel or normal to the v-notch or flat 52 of the wafer. The outline of die 50 are shown for illustration purposes of the diagonal alignment of grinding marks 48 with respect to the edges of the die.

Figure 6:
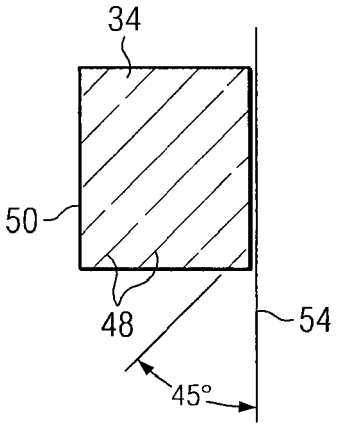
FIG. 6 illustrates grind marks oriented on a 45-degree diagonal to edges of the die.

FIG. 6 shows further detail of grind marks 48 running diagonally across the backside surface relative to reference line 54 oriented along the edges of the rectangular die 50. The linear grind marks 48 are created by the directional motion of grinding platform 40, which is aligned to the diagonal of reference line 54 of wafer 30.

Figure 7:
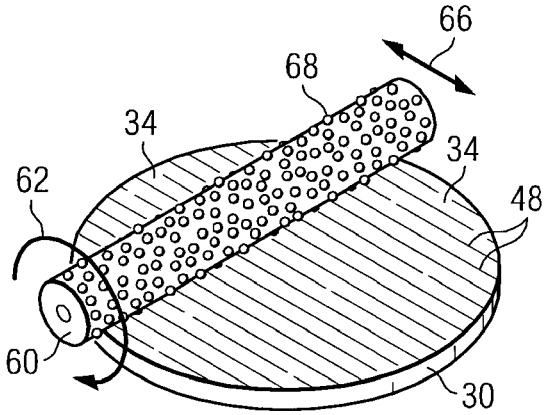
FIG. 7 illustrates a cylinder having an abrasive surface to form linear grind marks oriented on a diagonal to edges of the die.

FIG. 7 illustrates a cylindrical embodiment of grinding platform 40. Grinding cylinder 60 rolls across the backside surface of wafer 30 according to arrow 62 in a back and forth motion by directional arrow 66. Grinding cylinder 60 contains abrasive surface 68, which creates grind marks 48 on backside surface 34.

Figure 8:
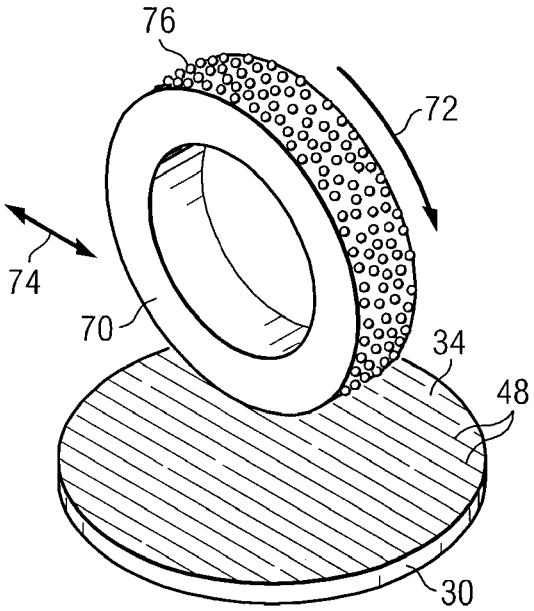
FIG. 8 illustrates a wheel having an abrasive surface to form linear grind marks oriented on a diagonal to edges of the die.

FIG. 8 illustrates a wheel embodiment of grinding platform 40. Grinding cylinder 70 rolls across the backside surface of wafer 30 according to arrow 72 in a back and forth motion by directional arrow 74. Grinding wheel 70 contains abrasive surface 76, which creates grind marks 48 on backside surface 34.

Block 28 of FIG. 2 shows the mounting and de-taping step to complete the backside grinding process.

The diagonal grind marks reduces die cracking for applications relying solely on backside grinding to planarize the back surface of the wafer. The diagonal grinding process described herein increases the strength of the die, particularly around the edges. The directional backside grinding also eliminates the need for CMP, which can cause ion contamination from the slurry resulting in wafer breakage or damage during the polishing process. Accordingly, directional backside grinding reduces wafer fabrication costs.

While one or more embodiments of the present invention have been illustrated in detail, the skilled artisan will appreciate that modifications and adaptations to those embodiments may be made without departing from the scope of the present invention as set forth in the following claims.

What is claimed is:

1. A semiconductor device, comprising:

a semiconductor wafer including, (a) a plurality of semiconductor die comprising edges oriented along a reference line, (b) radial grind marks formed on a first surface of the semiconductor wafer to a first depth, (c) linear grind marks formed on the first surface of the semiconductor wafer at an angle to the reference line to a second depth, and (d) a semiconductor circuit formed on a second surface of the semiconductor wafer opposite the first surface of the semiconductor wafer.

2. The semiconductor device of claim 1, wherein the linear grind marks are oriented 45 degrees with respect to the reference line.

3. The semiconductor device of claim 1, wherein the linear grind marks are formed by a cylinder having an abrasive surface.

4. The semiconductor device of claim 1, wherein the linear grind marks are formed by a wheel having an abrasive surface.

5. The semiconductor device of claim 1, wherein the linear grind marks are oriented diagonal with respect to the reference line to increase a strength of the plurality of semiconductor die to resist cracking.

6. A semiconductor device, comprising:

a semiconductor wafer including, (a) a plurality of semiconductor die, (b) radial grind marks formed on a first surface of the semiconductor wafer to a first depth, and (c) linear grind marks formed on the first surface of the semiconductor wafer to a second depth and diagonally with respect to edges of the plurality of semiconductor die.

7. The semiconductor device of claim 6, wherein the semiconductor wafer is aligned with the edges of the plurality of semiconductor die oriented along a reference line.

8. The semiconductor device of claim 7, wherein the linear grind marks are oriented 45 degrees with respect to the reference line.

9. The semiconductor device of claim 6, wherein the linear grind marks are formed by a cylinder or wheel having an abrasive surface.

10. The semiconductor device of claim 6, wherein the linear grind marks are formed by an abrasive surface having at least a 4000 mesh count.

11. The semiconductor device of claim 6, wherein the linear grind marks are oriented diagonal with respect to the edges of the plurality of semiconductor die to increase a strength of the plurality of semiconductor die to resist cracking.

12. A semiconductor device, comprising:

a semiconductor wafer including, (a) a semiconductor die, (b) first grind marks formed on a surface of the semiconductor wafer to a first depth, and (c) linear grind marks formed on the surface of the semiconductor wafer to a second depth and oriented diagonal to an edge of the semiconductor die.

13. The semiconductor device of claim 12, wherein the semiconductor wafer is aligned with the edge of the semiconductor die oriented along a reference line.

14. The semiconductor device of claim 13, wherein the linear grind marks are oriented 45 degrees with respect to the reference line.

15. The semiconductor device of claim 12, wherein the linear grind marks are formed by a cylinder having an abrasive surface.

16. The semiconductor device of claim 12, wherein the linear grind marks are formed by a wheel having an abrasive surface.

17. The semiconductor device of claim 12, wherein the linear grind marks are formed by an abrasive surface having at least a 4000 mesh count.

18. The semiconductor wafer of claim 12, wherein the linear grind marks are oriented diagonal with respect to the edge of the semiconductor die to increase a strength of the semiconductor die to resist cracking.

19. A semiconductor device, comprising:

a semiconductor die;

first grind marks formed on a surface of the semiconductor die; and second grind marks formed on the surface of the semiconductor die and oriented diagonal to an edge of the semiconductor die.

20. The semiconductor device of claim 19, wherein the semiconductor die is aligned with the edges of the semiconductor die oriented along a reference line.

21. The semiconductor device of claim 20, wherein the second grind marks are oriented 45 degrees with respect to the reference line.

22. The semiconductor device of claim 19, wherein the second grind marks are formed by a cylinder including an abrasive surface.

23. The semiconductor device of claim 19, wherein the second grind marks are formed by a wheel including an abrasive surface.

24. The semiconductor device of claim 19, wherein the second grind marks are formed with an abrasive surface including at least a 4000 mesh count.

25. The semiconductor device of claim 19, wherein the second grind marks are oriented diagonal with respect to the edges of the semiconductor die to increase a strength of the semiconductor die to resist cracking.

* * * * *